US007008251B2

(12) United States Patent
Ripper et al.

(10) Patent No.: US 7,008,251 B2
(45) Date of Patent: Mar. 7, 2006

(54) PLUG CONNECTOR AND METHOD FOR INSULATING A CONNECTING REGION OF A CONTACT ELEMENT OF THE PLUG CONNECTOR

(75) Inventors: Hartmut Ripper, Darmstadt (DE); Mile Trajkov, Frankfurt (DE)

(73) Assignee: Tyco Electronics AMP GmbH, Bensheim (DE)

( * ) Notice: Subject to any disclaimer, the term of this patent is extended or adjusted under 35 U.S.C. 154(b) by 0 days.

(21) Appl. No.: 10/987,885

(22) Filed: Nov. 12, 2004

(65) Prior Publication Data

US 2005/0112912 A1 May 26, 2005

(30) Foreign Application Priority Data

Nov. 12, 2003 (EP) ..... 03026064

(51) Int. Cl.
*H01R 13/52* (2006.01)

(52) U.S. Cl. ..... 439/279; 174/35 C

(58) Field of Classification Search ..... 439/188, 439/274, 275, 279, 587, 589; 200/51.1; 174/35 C, 174/35 R, 74 A, 74 R, 75 C
See application file for complete search history.

(56) References Cited

U.S. PATENT DOCUMENTS

| | | | | |
|---|---|---|---|---|
| 4,538,869 | A * | 9/1985 | Richards | 439/596 |
| 5,076,806 | A * | 12/1991 | Hotea et al. | 439/595 |
| 5,426,715 | A * | 6/1995 | Moisson et al. | 385/76 |
| 5,460,540 | A * | 10/1995 | Reichle | 439/445 |
| 5,886,294 | A * | 3/1999 | Scrimpshire et al. | 174/35 R |
| 6,402,538 | B1 * | 6/2002 | Suzuki | 439/271 |
| 6,429,373 | B1 * | 8/2002 | Scrimpshire et al. | 174/74 R |
| 6,527,586 | B1 * | 3/2003 | Okamura et al. | 439/587 |

FOREIGN PATENT DOCUMENTS

DE 40 15 793 A1 12/1990

* cited by examiner

*Primary Examiner*—Thanh-Tam Le

(74) *Attorney, Agent, or Firm*—Barley Snyder LLC

(57) ABSTRACT

A plug connector has a housing having a contact element extending therefrom. The contact element has a connecting region arranged outside of the housing for electrically connecting the contact element to an electrical lead. A sealing element surrounds the connecting region. The sealing element is axially slideable along the connecting region into engagement with the housing.

13 Claims, 7 Drawing Sheets

PLUG CONNECTOR AND METHOD FOR INSULATING A CONNECTING REGION OF A CONTACT ELEMENT OF THE PLUG CONNECTOR

FIELD OF THE INVENTION

The invention relates to a plug connector and a method with which a connecting region of a contact element of the plug connector is insulated.

BACKGROUND OF THE INVENTION

DE 4015793 A1 teaches a connector having a housing with a contact element. The contact element is connected to an electrical lead at a connecting region. A seal is positioned on the electrical lead adjacent to the connecting region on a side opposite from the housing. The seal and connecting region are arranged in an aperture in the housing. The electrical lead extends from the housing through a holder and a sealing cover. An end section of the sealing cover is sealed by an insert.

SUMMARY OF THE INVENTION

An object of the present invention is to provide a plug connector in which a connecting region of a contact element can be easily insulated and sealed.

This and other objects are achieved by a plug connector with a housing having a contact element extending therefrom. The contact element has a connecting region arranged outside of the housing for electrically connecting the contact element to an electrical lead. A sealing element surrounds the connecting region. The sealing element is axially slideable along the connecting region into engagement with the housing.

This and other objects are further achieved by a connector assembly comprising a first connector and a second connector. The first connector has a housing with a contact element. The contact element includes a connecting region and a female plug member. The connecting region is arranged outside of the housing for electrically connecting the contact element to an electrical lead. The female plug member has an actuation projection extending adjacent thereto. A sealing element surrounds the connecting region and is axially slideable along the connecting region into engagement with the housing. The second connector includes a contact pin corresponding to the female plug member and a short-circuit spring. The short-circuit spring has a central protrusion and a curved contact portion. The curved contact portion engages the contact pin. When the second connector is mated with the first connector, the actuation projection of the first connector engages the central protrusion to flex the curved contact portion away from the contact pin.

DETAILED DESCRIPTION OF THE INVENTION

Figure 1:
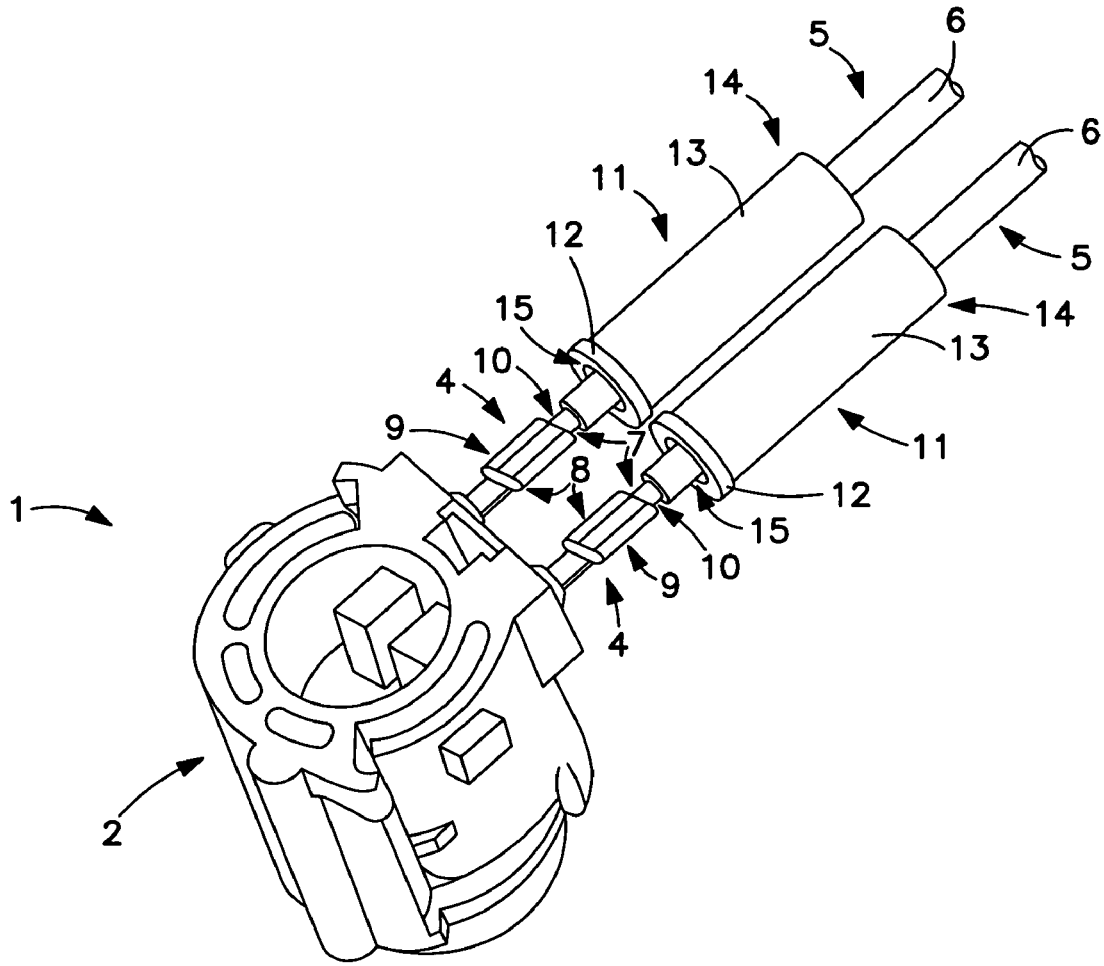
FIG. 1 is a perspective view of a plug connector with sealing elements attached to electrical leads.

FIG. 1 is a perspective view of a plug connector 1 according to the invention. The plug connector 1 includes a housing 2. Contact elements 8 extend from the housing 2. Each of the contact elements 8 has a connecting region 4. Each of the connecting regions 4 includes a connecting portion 9. The connecting portion 9 may be, for example, a crimping region. Each of the connecting portions 9 electrically, conductively, and mechanically connects a wire 7 of an electrical lead 6 to each of the contact elements 8. The electrical lead 6 comprises an insulating sheath 5 and a stripped end 10 that exposes the wire 7.

A sealing element 11 is arranged on each of the electrical leads 6. The sealing elements 11 are arranged on each of the electrical leads 6 before the contact elements 8 are connected to the wires 7. Each of the sealing elements 11 can be slid along the electrical lead 6 and the connecting region 4. In FIG. 1, the sealing element 11 is shown in an initial position arranged at a distance from the housing 2.

Figure 2:
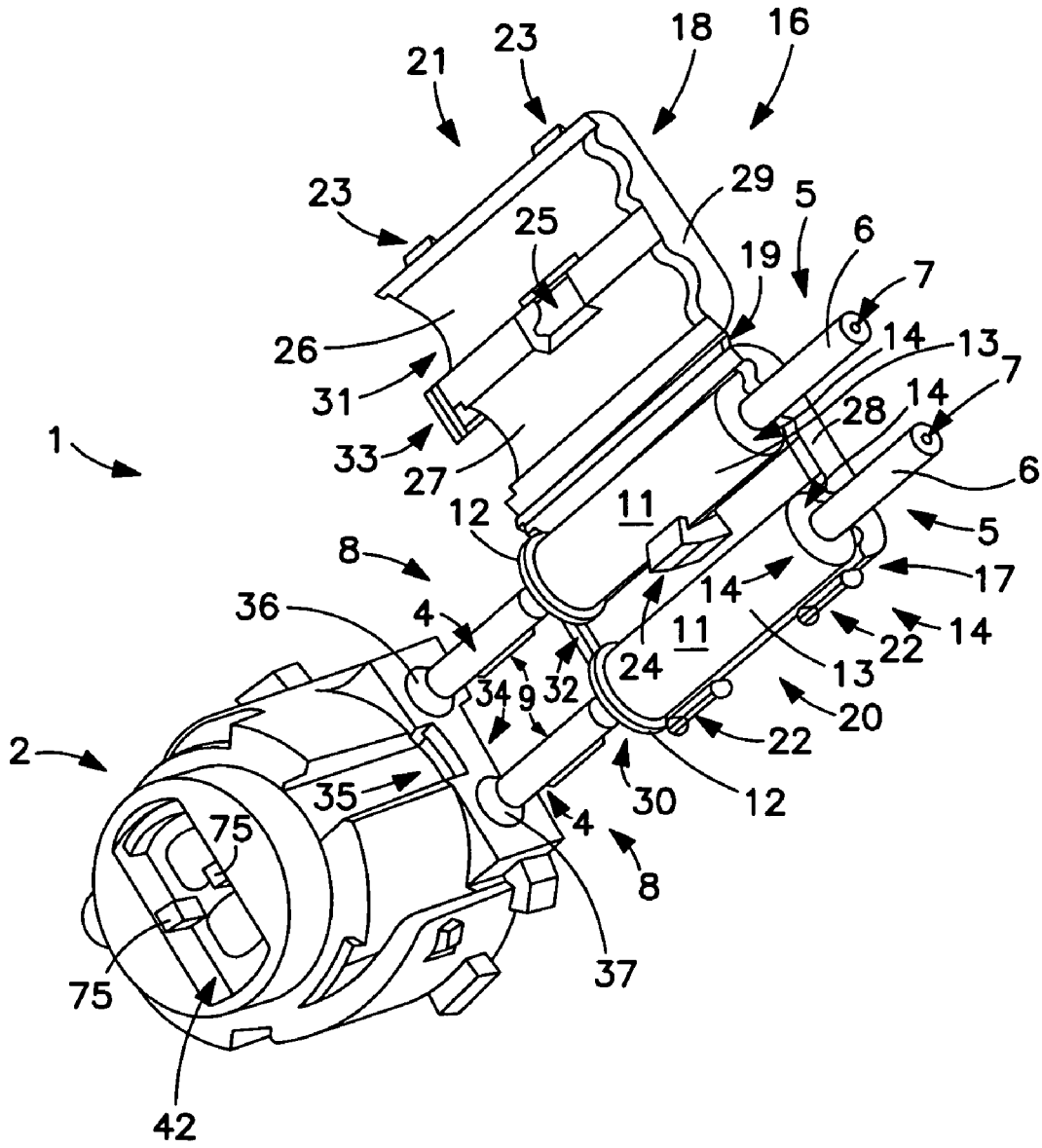
FIG. 2 is a perspective view of the plug connector with a holder attached to the sealing elements.

Each of the sealing elements 11 has a substantially hollow cylindrical construction. The sealing elements 11 are of approximately the same height, relative to the connecting region 4 and the electrical lead 6. On a side of the housing 2, each of the sealing elements 11 has a substantially annular abutment collar 12. Each of the abutment collars 12 protrudes radially from cylindrical portions 13 of the sealing elements 11. In a region of the abutment collars 12, the sealing elements 11 have cylindrical inner profiles 15. As shown in FIG. 2, the sealing elements 11 rests against the electrical leads 6 in a radial sealing manner on end faces 14 opposing the abutment collars 12. The sealing element 11 is preferably produced from an elastomer, for example rubber.

Figure 3:
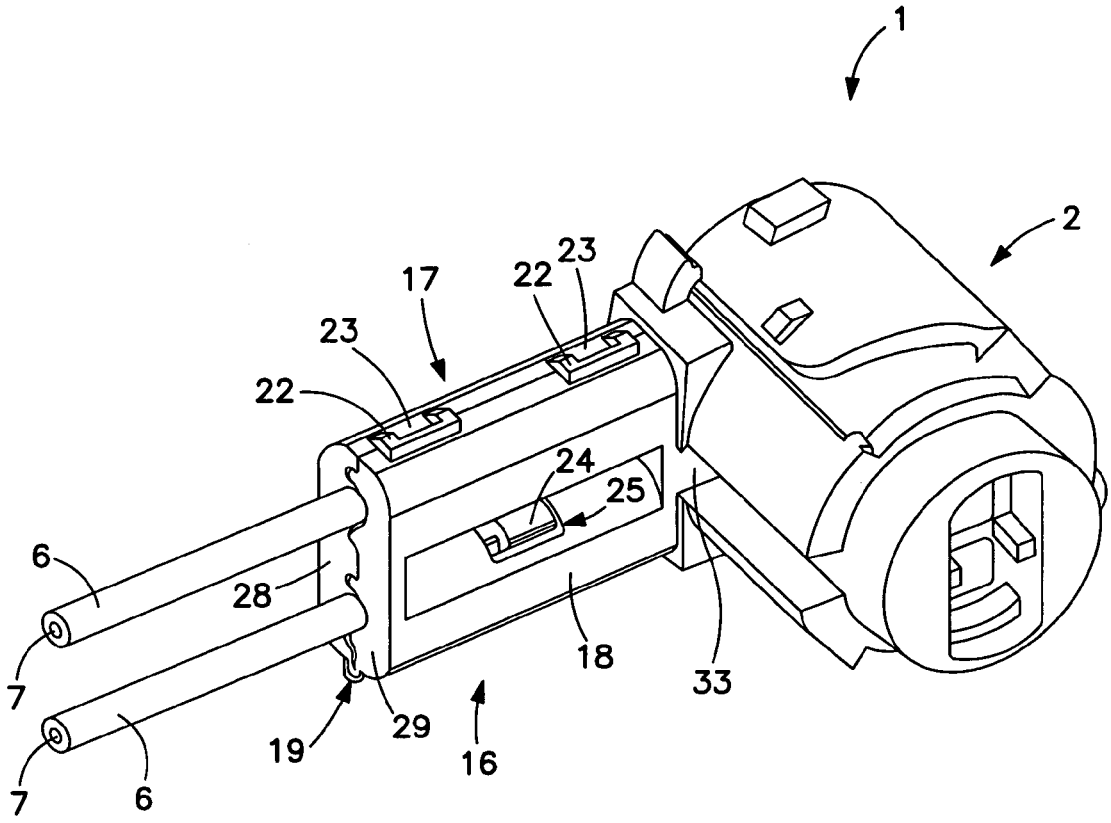
FIG. 3 is a perspective view of the plug connector with the holder in a closed position.

The sealing elements 11 are arranged in a holder 16 approximately parallel to one another when the holder 16 is in an open position, as shown in FIG. 2. The holder 16 comprises a first holder member 17 and a second holder member 18. The first holder member 17 is pivotably and hingeably connected to the second holder member 18 by a film hinge 19. The first and second holder members 17, 18 pivot about the film hinge 19 from the open position shown in FIG. 2 to a closed position shown in FIG. 3. The film hinge 19 and the first and second holder members 17, 18 in this embodiment are integrally formed from a plastic material.

As shown in FIG. 2, corresponding latching elements 22, 23 are formed on faces 20, 21 of the first and second holder members 17, 18 opposing the film hinge 19. The latching elements 22, 23 are latched to one another in the closed position to hold the first and second holder members 17, 18 in the closed position. The first holder member 17 further comprises a centrally arranged and inwardly protruding latching hook 24. The latching hook 24 corresponds to a latching aperture 25 formed in the second holder member 18. The latching hook 24 and the latching aperture 25 further secure the first and second holder members 17, 18 in the closed position.

The first and second holder members 17, 18 comprise recesses 26, 27 corresponding to outer contours of the sealing elements 11. Only the recesses 26, 27 of the second holder member 18 are visible in FIG. 2. The sealing elements 11 are received in the recesses 26, 27 of the first and second holder members 17, 18 such that the end faces 14 of the sealing elements 11 abut the rear walls 28, 29 of the of the first and second holder members 17, 18, and the abutment collars 12 of the sealing elements 11 protrude from front faces 30, 31 of the first and second holder members 17, 18.

At the front faces 30, 31, the first and second holder members 17, 18 have latch members 32, 33 that correspond to opposing latching recesses 34, 35 on the housing 2. In the closed position, the latch members 32, 33 of the first and second holding members 17, 18 are arranged on the front faces 30, 31 of the first and second holder members 17, 18 in positions corresponding to the latching recesses 34, 35.

Figure 4:
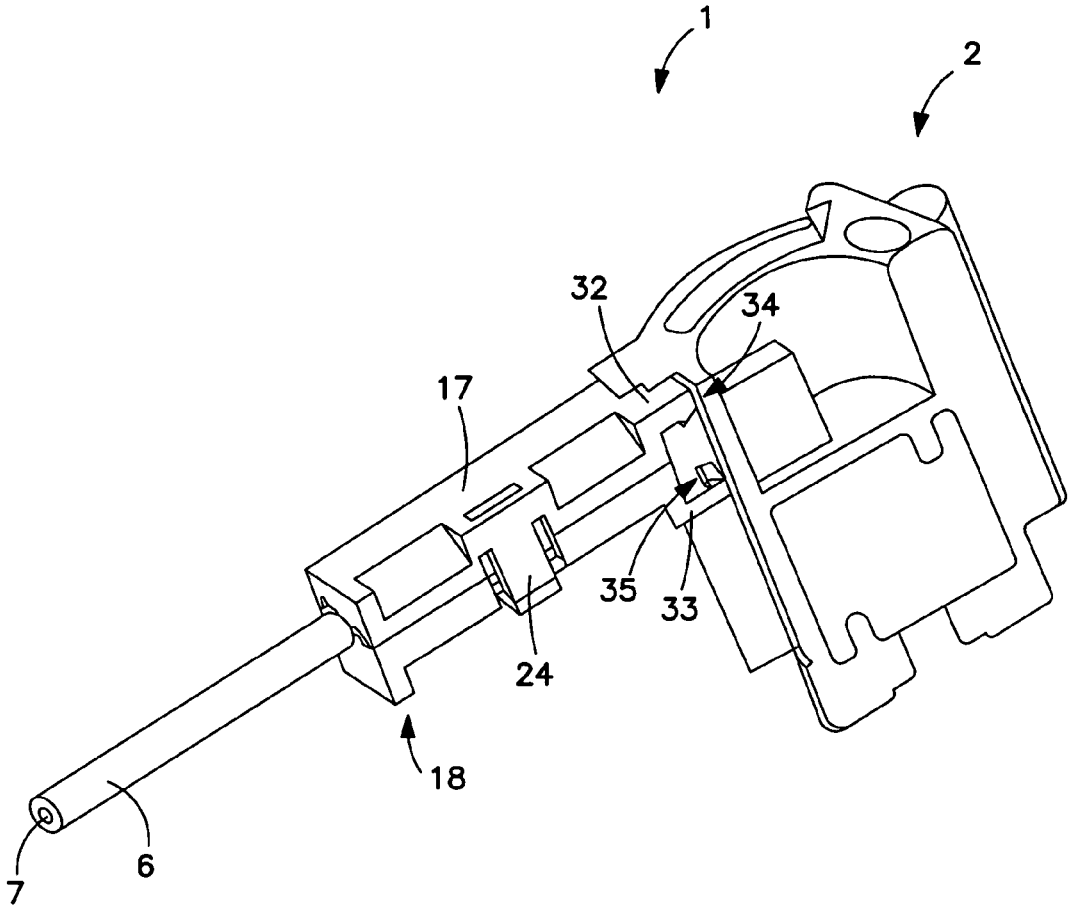
FIG. 4 is a perspective sectional view along a central longitudinal section of the plug connector shown in FIG. 3.
Figure 5:
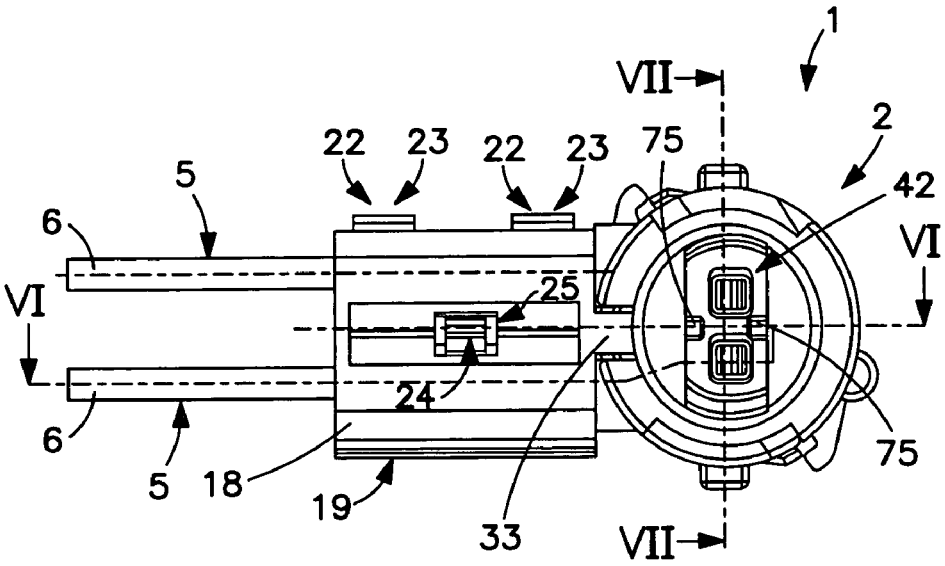
FIG. 5 is a bottom view of the plug connector with the holder in a closed position.

In the closed position, the sealing elements 11 are pressed radially onto the electrical leads 6 by the first and second holder members 17, 18. The holder 16 and the sealing elements 11, however, remain axially slidable relative to the electrical leads 6 and the connecting regions 4. By displacing the holder 16 and the sealing elements 11 arranged therein along the electrical leads 6 and the connecting regions 4 on the housing 2, the latch members 32, 33 on the front faces 30, 31 of the first and second holder members 17, 18 come into latching engagement with the latching recesses 34, 35 on the housing 2, as best shown in FIG. 4. As a result, the sealing elements 11 are releasably fixed to the housing 2 in an axial direction relative to the electrical leads 6 and the connecting regions 4. In this state, the abutment collars 12 of the sealing elements 11 are also sealingly pressed against the housing 2.

Figure 6:
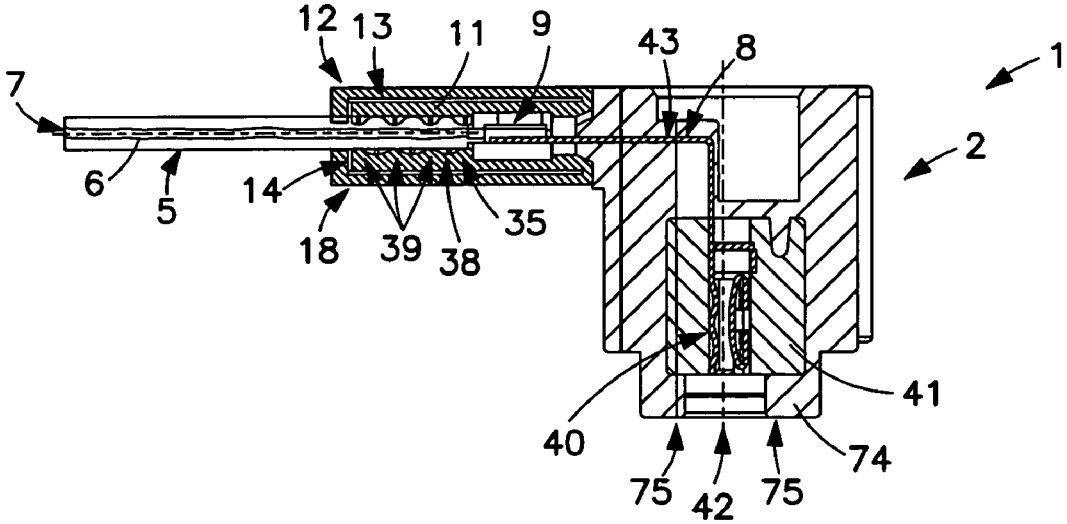
FIG. 6 is a sectional view of the plug connector taken along line VI—VI of FIG. 5.

As shown in FIG. 2, abutment members 36, 37 are formed on the housing 2 in regions where the contact elements 8 emerge from the housing 2. Each of the abutment members 36, 37 surrounds the contact elements 8 and is constructed in the form of a truncated cone. The abutment members 36, 37 can be brought into engagement with the cylindrical inner profiles 15 of the sealing elements 11, as shown in FIG. 6. The cylindrical inner profiles 15 slide over the abutment members 36, 37 and are resiliently flared. In the flared state, the cylindrical inner profiles 15 rest against the abutment members 36, 37 with increased radial sealing force. In this position the connecting regions 4 of the contact elements 8 and the stripped end 10 of the electrical leads 6 are respectively insulated and sealed along their entire length.

As shown in FIG. 6, the cylindrical portions 13 of the sealing elements 11 have inside surfaces 38 each have a series of projections 39 that form an approximate wave-shaped profile at the sides of the end faces 14. The projections 39 on the inside surfaces 38 form a multi-stepped seal and rest against the electrical lead 6. In this embodiment of the invention, the projections 39 rest against the insulating sheaths 5 of the electrical leads 6. In an alternative embodiment of the invention, the sealing elements 11 can also rest against the connecting regions 4 and/or the stripped ends 10 of the electrical leads 6.

Figure 7:
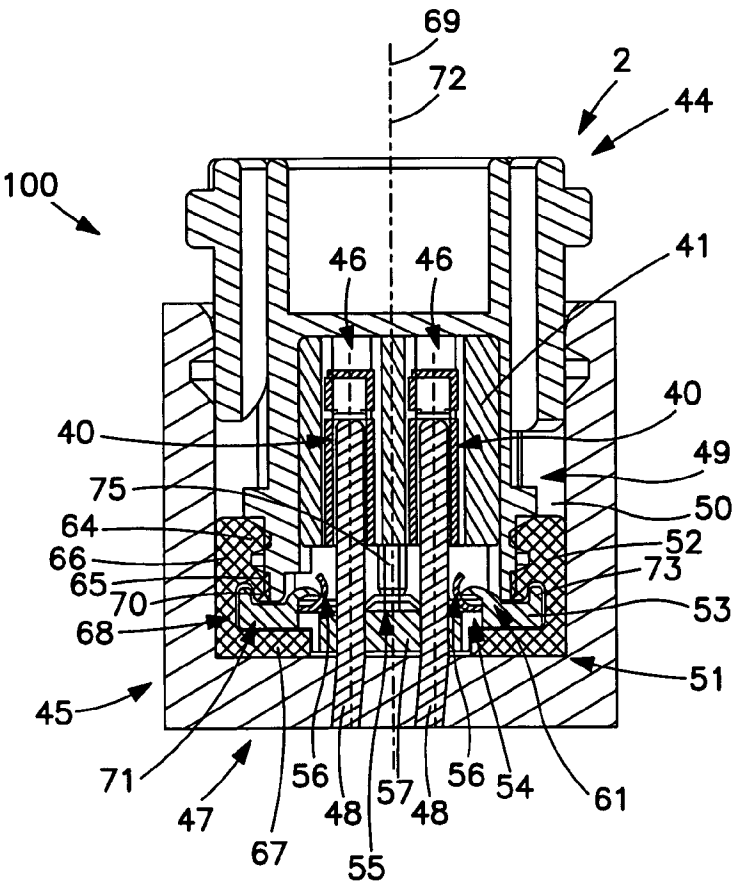
FIG. 7 is a sectional view of a connector assembly showing a first connector mated with a second connector.

The contact elements 8 have female plug members 40 arranged within through-holes 46 of the ferrite core 41, as shown in FIGS. 6 and 7. The female plug members 40 have contact regions for contacting complementary contacts. The ferrite core 41 is arranged in an interior of the housing 2 and is accessible from an outside of the housing 2 through an aperture 42 in the housing 2, as shown in FIG. 6. An inner portion 43 of the contact element 8 and the ferrite core 41 are cast into the housing 2. In other words, the housing 2 is constructed by molding the ferrite core 41 and the inner portion 43 of the contact element 8. The contact element 8 is thereby secured in the housing 2. In the cast region, the contact element 8 is insulated and sealed by the housing 2. The construction of the housing 2 and the partial casting of the contact element 8 therefore occur chronologically before and independently of the connection of the electrical wire 7 to the contact element 8.

FIG. 7 shows a connector assembly 100 comprising a first connector 44 and a second connector 45. The first connector 44 corresponds to the second connector 45. The first connector 44 represents the plug connector 1 of FIGS. 1–6. The second connector 45 can form part of an ignition component, such as, for example, an ignition generator for an airbag or an elevation mechanism for a motor vehicle bonnet, wherein the elevation mechanism is protected from the weather.

Figure 9:
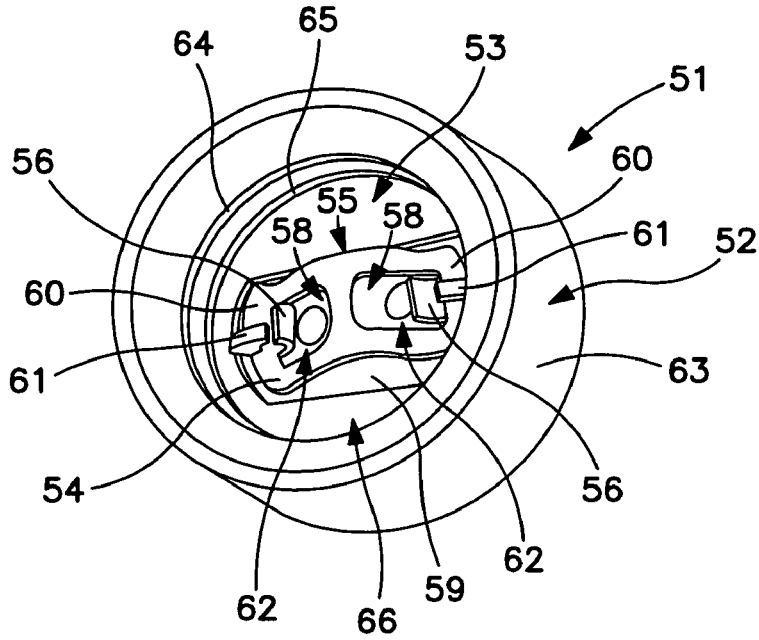
FIG. 9 is a perspective view of an insertion assembly of the second connector.
Figure 10:
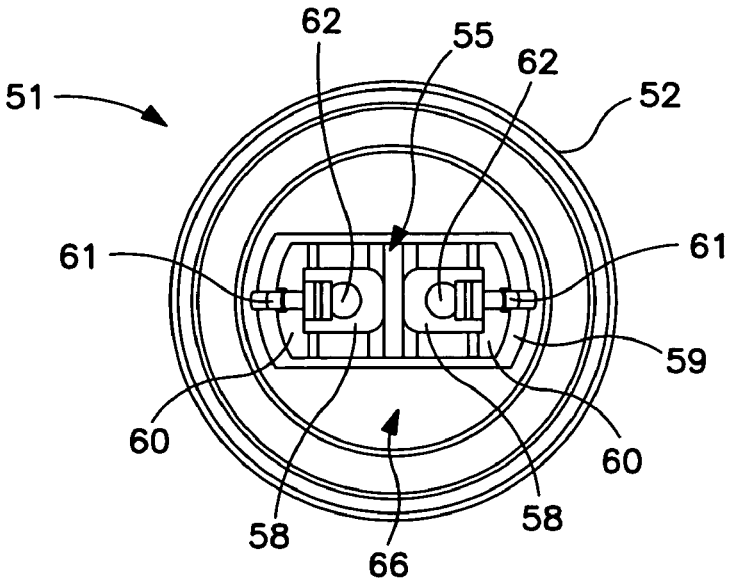
FIG. 10 is a plan view of the insertion assembly of the second connector.

The second connector 45 is of a substantially hollow construction and comprises contact pins 48, which extend through a base 47 of the second connector 45 and into a substantially cylindrical interior 49 of the second connector 45. The contact pins 48 are complementary to the female plug members 40. An insertion assembly 51 is arranged in the substantially cylindrical interior 49 of the second connector 45. As shown in FIGS. 9–10, the insertion assembly 51 includes a seal 52 having a holding insert 53 fastened thereto. The holding insert 53 is mirror symmetrically constructed and may be formed, for example, from a plastic material. The seal 52 may be formed, for example, from an elastomer, such as rubber.

A short-circuit spring 54 is arranged on the holding insert 53 for short-circuiting the contact pins 48. The short-circuit spring 54 is electrically conductive and integrally constructed and has a central protrusion 55. The central protrusion 55 can be pressed flat and may be formed, for example, from a resilient metal. Spacing between substantially curved contact portions 56 of the short-circuit spring 54 varies according to a height of the central protrusion 55. As best seen in FIG. 9, the short-circuit spring 54 is symmetrically constructed. The short-circuit spring 54 has cut-outs 58 markedly larger than a diameter of the contact pins 48. In this manner, the short-circuit spring 54 can come into contact with the contact pins 48 only with the curved contact portions 56.

As shown FIG. 9, the holding insert 53 includes a guide recess 59 for receiving the short-circuit spring 54. The guide recess 59 guides the short-circuit spring 54 when the central protrusion 55 is pressed so that the short-circuit spring 54 becomes substantially flat. When the central protrusion 55 is pressed, the length of the short-circuit spring 54 is altered together with the spacing of the curved contact portions 56, and at least one end 60 of the short-circuit spring 54 slides in the guide recess 59. Two retaining lugs 61 partially project over the guide recess 59 from the holding insert 53 and oppose one another. The retaining lugs 61 hold the ends 60 of the short-circuit spring 54 in the guide recess 59. In a region of the guide recess 59, the holding insert 53 comprises contact pin receiving through-holes 62 through which the contact pins 48 can respectively extend. The short-circuit spring 54 is therefore received in a precise and defined manner relative to the holding insert 53. Thus, the position of the short-circuit spring 54 relative to the seal 52 is improved.

Figure 8:
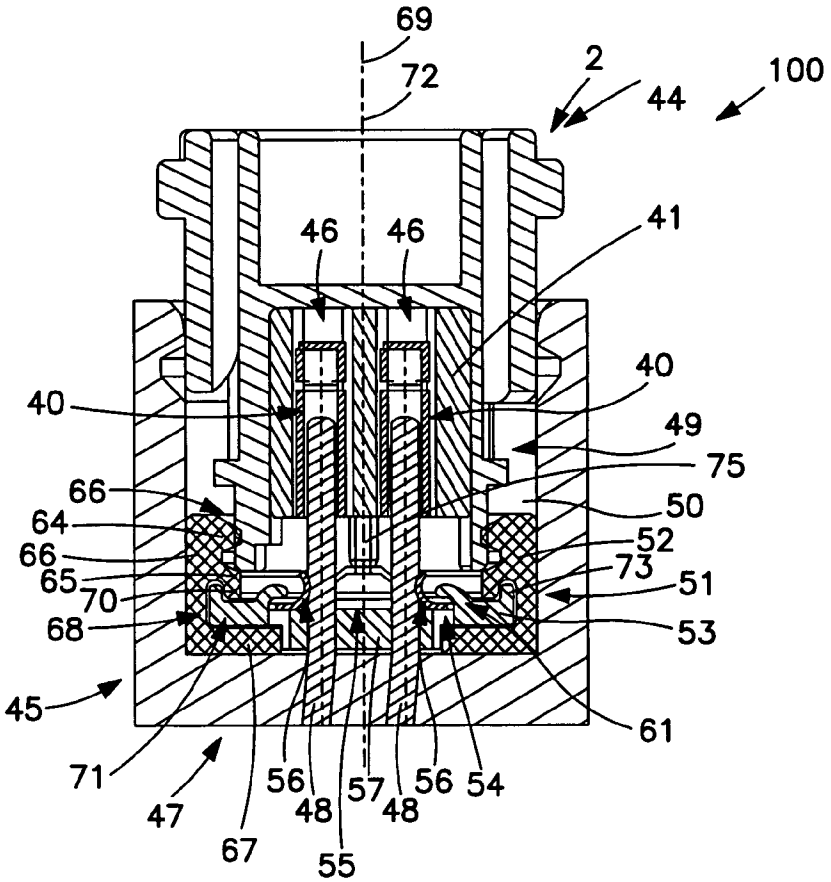
FIG. 8 is a sectional of the connector assembly showing the first connector before it is mated with the second connector.

If the central protrusion 55 is pressed in a direction of a base 57 of the holding insert 53, the curved contact portions 56 are positioned at a distance from the contact pins 48, as shown in FIG. 7. Because the short-circuit spring 54 is of a curved construction, the contact pins 48 are not short-circuited when the central protrusion 55 is pressed. If the central protrusion 55 is in an initial position, as shown in FIG. 8, the curved contact portions 56 abut against the contact pins 48. In this manner, the contact pins 48 are short-circuited by the short-circuit spring 54.

As shown in FIGS. 9 and 10, the seal 52 is mirror-symmetrically constructed and comprises a rotationally symmetrical outer wall 63. From the outer wall 63, first and second rotationally symmetrical sealing lips 64, 65 extend into the interior 66 of the seal 52. As shown in FIGS. 7 and 8, the first sealing lip 64 has a substantially triangular or crest-like cross-sectional profile, which can be peripherally ribbed on an inner region. The second sealing lip 65 is arranged at a distance from the first sealing lip 64 and forms a peripheral groove 68 together with a base portion 67 of the seal 52. A peripheral axial projection 70 of the second sealing lip 65 extends approximately parallel to a first central axis 69 of the seal 52 in a direction of the base portion 67. In this manner, the peripheral groove 68 undercuts the second sealing lip 65. The second sealing lip 65 can be constructed to be peripherally ribbed on at least one of its peripheral faces.

The holding insert 53 includes an axial collar 73 projecting axially in a direction of a second central axis 72 of the holding insert 53 on an outer periphery 71 thereof. The holding insert 53 rests against the base portion 67 of the seal 52 in a region of the outer periphery 71. The collar 73 of the holding insert 53 grips behind the second sealing lip 65 of the seal 52 in the peripheral groove 68 so that the second sealing lip 65 presses against the holding insert 53. In this manner, the holding insert 53 is held in an axially and radially defined position with respect to the seal 52.

As shown in FIG. 6, an abutment portion 74 of the first connector 44 surrounds the housing aperture 42 and is of a substantially cylindrical construction. The abutment portion 74 is positioned in the interior 66 of the seal 52 when the first connector 44 is inserted in a final position in the second connector 45. The first and second sealing lips 64, 65 rest against the exterior of the abutment portion 74, and the abutment portion 74 rests against the holding insert 53. The axial projection 70 of the second sealing lip 65 is pressed radially outwards against the axial collar 73 of the holding insert 53. As a result, the second sealing lip 65 seals both the second connector 44 and the holding insert 53.

The first connector 44 comprises actuation projections 75 opposing one another and extending radially inwardly into the housing aperture 2, as shown in FIGS. 2, 5, 7 and 8. When inserting the first connector 44 into the second connector 45, the actuation projections 75 abut against the central protrusion 55 of the short-circuit spring 54. As the second connector 44 is inserted further, the protrusion 55 is pressed in the direction of the base 57 of the holding insert 53 and the short-circuiting of the two contact pins 48 is removed. When withdrawing the first connector 44 from the second connector 45, the short-circuit spring 54 resiles and the short-circuiting of the contact pins 48 is restored.

The second connector 45 and the insertion assembly 51 is independent of the sealing and insulating of the connecting regions 4 emerging from the housing 2 and vice versa. Connecting regions and/or un-insulated portions of electrical leads of other electrical components can also be sealed in the manner disclosed herein relative to the sealing elements 11. Additionally, contact pins other than the contact pins 48 of the second connector 45 can be short-circuited and/or sealed in the manner disclosed herein relative to the insertion assembly 51 and independent of the construction of the longitudinally displaceable sealing element 11.

We claim:

1. A connector assembly, comprising:

a first connector having a housing with a contact element, the contact element including a connecting region and a female plug member, the connecting region being arranged outside of the housing for electrically connecting the contact element to an electrical lead, the female plug member having an actuation projection extending adjacent thereto;

a sealing element surrounding the connecting region, the sealing element being axially slideable along the connecting region into engagement with the housing; and a second connector with a contact pin corresponding to the female plug member, the second connector having a short-circuit spring with a central protrusion and a curved contact portion that engages the contact pin, the actuation projection of the first connector engages the central protrusion to flex the curved contact portion away from the contact pin when the second connector is mated with the first connector.

2. The connector assembly of claim 1, wherein the sealing element includes an abutment collar that receives an abutment member formed on the housing when the sealing element is brought into engagement with the housing.

3. The connector assembly of claim 1, further comprising a holder that receives the sealing element and is axially slideable therewith.

4. The connector assembly of claim 3, wherein the holder includes latch members that secure the holder to the housing.

5. The connector assembly of claim 3, wherein the holder includes latching elements that secure the holder to the sealing element such that the holder radially presses the sealing element.

6. The connector assembly of claim 5, wherein the holder includes first and second holder members that are attached by a film hinge.

7. The connector assembly of claim 1, wherein the sealing element includes an inside surface having a series of projections.

8. The connector assembly of claim 7, wherein the series of projections are formed at a side of the sealing element opposite from the housing.

9. The connector assembly of claim 1, wherein the short-circuit spring is arranged on a plastic holding insert in a seal.

10. The connector assembly of claim 1, wherein the contact pin extends through a contact pin receiving through-hole in the short-circuit spring.

11. A connector assembly, comprising:

a first connector having a housing with a contact element, the contact element including a connecting region and a female plug member, the connecting region being arranged outside of the housing for electrically connecting the contact element to an electrical lead, the female plug member having an actuation projection extending adjacent thereto; and a second connector with a contact pin corresponding to the female plug member, the second connector having a short-circuit spring with a central protrusion and a curved contact portion that engages the contact pin, the actuation projection of the first connector engages the central protrusion to flex the curved contact portion away from the contact pin when the second connector is mated with the first connector.

12. The connector assembly of claim 11, wherein the short-circuit spring is arranged on a plastic holding insert in a seal.

13. The connector assembly of claim 11, wherein the contact pin extends through a contact pin receiving through-hole in the short-circuit spring.

* * * * *